United States Patent [19]

Chyten

[11] 4,090,543

[45] May 23, 1978

[54] TENNIS RACKET COVER

[75] Inventor: Norman M. Chyten, Needham, Mass.

[73] Assignee: Almont Manufacturing Co., Inc., Boston, Mass.

[21] Appl. No.: 768,035

[22] Filed: Feb. 14, 1977

[51] Int. Cl.[2] ..... A63B 49/18

[52] U.S. Cl. ..... 150/52 G

[58] Field of Search ..... 150/52 G; D87/1 R; 190/52; 273/74

[56] References Cited

U.S. PATENT DOCUMENTS

| | | | |
|---|---|---|---|
| D. 231,150 | 4/1974 | Berry | D87/1 R |
| 2,134,411 | 10/1938 | Marx | 150/52 G |
| 2,429,856 | 10/1947 | Vasquez | 190/52 UX |

*Primary Examiner*—Donald F. Norton

*Attorney, Agent, or Firm*—Wolf, Greenfield & Sacks

[57] ABSTRACT

A tennis racket cover having a pair of sheets sized and shaped to cover the opposite faces of tennis rackets. A third sheet covers and is secured at its periphery to the lower half of one of the pair of sheets to form a pocket designed to receive flat wallet-shaped objects. An elongated slot in the third sheet forms an opening which is closed by a zipper.

4 Claims, 6 Drawing Figures

FIG. 2
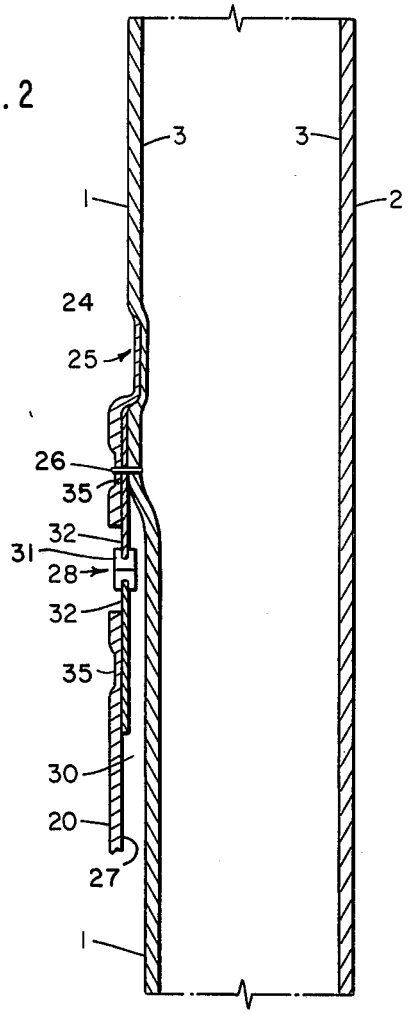
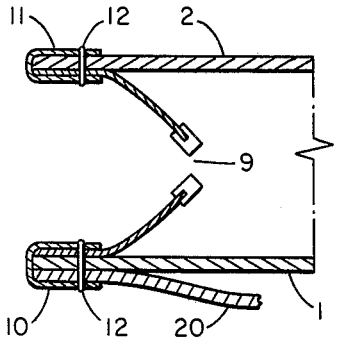
FIG. 3
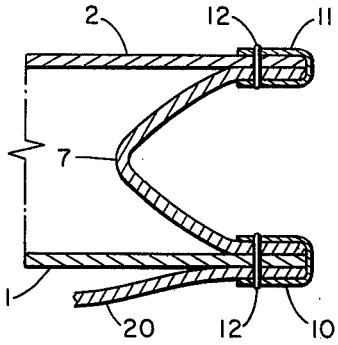
FIG. 4
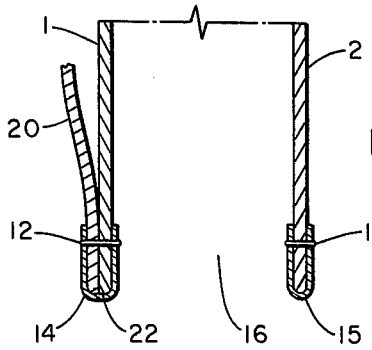
FIG. 5
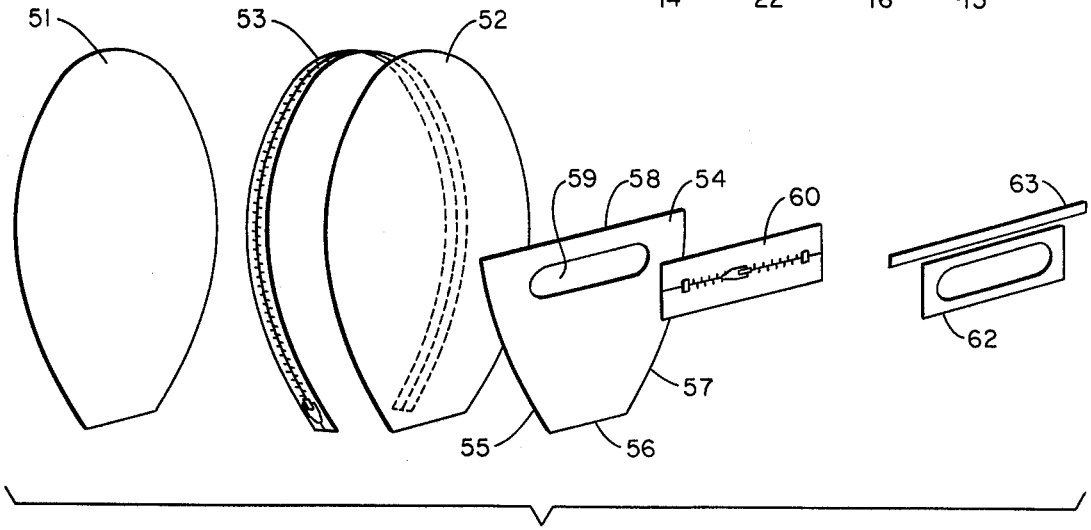
FIG. 6

TENNIS RACKET COVER

BACKGROUND OF THE INVENTION

Available tennis racket covers frequently provide large projecting and unattractive pockets on one of the faces of the cover. These pockets are designed primarily to hold tennis balls. Quite frequently, these pockets have snap covers which do not completely close. Additionally, such pockets are not shaped or sized to receive wallets, and because of their projecting bulk are unattractive and comparatively expensive to make. Most tennis enthusiasts do not use these pockets to carry tennis balls since they prefer to use the metal containers in which the tennis balls are usually sold. Consequently, these pockets are frequently not used or are used for purposes other than the purposes for which they were intended. In addition, tennis players will frequently use the tennis racket cover to hold key chains and wallets while actually playing tennis. Tennis racket covers with tennis ball pockets are not suited for such use since the pockets are not shaped to receive wallets.

It is therefore an object of the present invention to provide a tennis racket cover designed to be made inexpensively, and provide an attractive appearance, with the cover having an integrally formed pocket adapted to receive flat objects such as wallets or the like.

A further object of the present invention is to provide an improved tennis racket cover design adapted to be made with minimum stitching and in which the construction is sufficiently sturdy to withstand the normal abuse to which such covers are ordinarily subjected.

SUMMARY OF THE INVENTION

The present invention provides a tennis racket cover formed of a pair of facing front and rear sheets sized and shaped to cover the opposite faces of a tennis racket. The two sheets are secured together by a zipper at their peripheries along a major portion of their length with a space at one end providing an opening for a tennis racket handle. A third sheet facing and coextensive with one half of the second sheet forms a pocket with this second sheet. The pocket is opened through an elongated transverse slot in the third sheet which may be selectively closed by a zipper.

DESCRIPTION OF DRAWINGS

The foregoing objects and advantages of the present invention will be more clearly understood when considered in conjunction with the accompanying drawings, in which:

FIG. 2 is a cross sectional detail taken along the line 2—2 of FIG. 1;

FIG. 3 is a cross sectional detail taken along the line 3—3 of FIG. 1;

FIG. 4 is a cross sectional detail taken along the line 4—4 of FIG. 1;

FIG. 5 is a cross sectional detail taken along the line 5—5 of FIG. 1; and

FIG. 6 is an exploded view of an alternate construction.

DETAILED DESCRIPTION OF THE INVENTION

Figure 1:
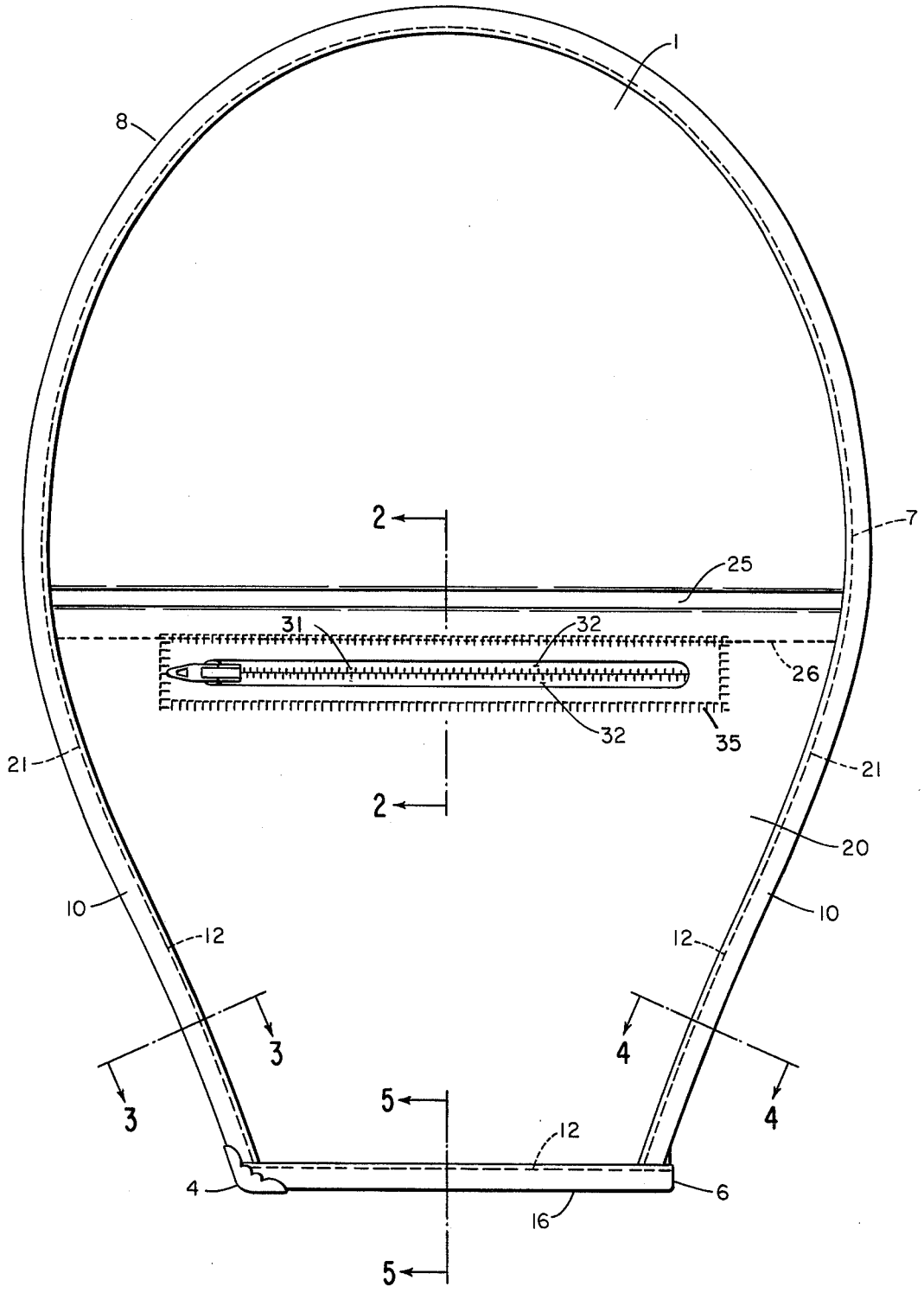
FIG. 1 is an elevational view of a tennis racket cover embodying a preferred form of the invention.

Referring to FIG. 1 there is illustrated a tennis racket cover designed for use with conventional tennis rackets of various sizes. This racket cover is designed to contain, in addition to a tennis racket, flat objects such as wallets and other small items such as a key ring and keys, so that a tennis player can use the cover to contain such items as wallets, keys, handkerchiefs and the like while actually playing tennis.

In the embodiment illustrated in FIGS. 1 through 5 inclusive, there is provided a pair of sheets 1 and 2, shaped and sized to receive the head of a tennis racket between them. These sheets 1 and 2 are preferably formed of a thermoplastic material which may, if desired, be coated with a fabric or flocking on their inner facing surfaces 3. The weight and thickness of the sheets 1 and 2 may vary depending upon the quality of the product specifically desired but the thickness should be sufficient to provide structural integrity and wearability but also provides sufficient flexibility to allow the cover to be easily bent. The sheets 1 and 2 are secured together from a first point 4 around the curved periphery to a second point 6 by a combination gusset and zipper. The gusset 7 (FIG. 4) extends from point 6 on the periphery of the sheets 1 and 2 to point 8. The zipper 9 extends on the periphery from point 8 to point 4. The zipper and gusset 7 and 9 respectively are secured at their edges respectively to sheets 1 and 2 by binding 10 and 11. These bindings 10 and 11 are stitched by stitching 12 along the entire length of the sheets 1 and 2 from point 6 to point 4. Additional bindings 14 and 15 are secured respectively to the sheets 1 and 2 between the points 6 and 4 at the open throat or end 16 of the cover. A third sheet 20 covers the lower half of sheet 1 of the racket cover with the periphery of the sheet 20 secured to sheet 1. The side edges 21 and lower edge 22 of the sheet 20 are coextensive with the lower half of the periphery of sheet 1 and are secured to it by stitching 12. The upper edge 24 of the sheet 20 is secured by a heat seal band 25 to the sheet 1. Additionally stitching 26 extending transversely of sheet 1 also secures the sheet 20 *tc* sheet 1. Sheet 20 may be made of material similar or identical to the material of which sheet 1 is formed and accordingly may be provided with a flocked or fabric surface 27. An elongated slot 28 parallel to the edge 24 is formed across the top of sheet 20. This slot has a sufficient length to permit insertion through it of flat wallet sized and shaped objects. This sheet and the opening 28 thereby cooperate with the lower porion of sheet 1 to form a pocket 30. A zipper assembly 31 having side members 32 is heat sealed by continuous segment of heat sealing 35 to the inner surface of sheet 20.

In an alternate construction, illustrated in FIG. 6, sheets 51 and 52 are shaped in size to fit about a tennis racket. These sheets are secured together directly by a continuous zipper assembly 53 without a gusset construction. The zipper assembly will open or separate about half its length. A third sheet 54 covers the lower half of the sheet 52 and is heat sealed to it along its side edges 55, 56, and 57. Side 58 is heat sealed across the center portion of sheet 52 so that a pocket is formed between the sheet 54 and lower half of sheet 52. A slot opening 59 is provided in sheet 54. A zipper assembly 60 is secured over the slot 58 by a slotted strip 62 of heat sealable plastic. An additional strip 63 may be heat sealed over the edge 58 of sheet 54 to secure it to sheet 52. The material of the embodiment of FIG. 6 may also be made of a flocked or unflocked thermoplastic material.

What is claimed is:

1. A tennis racket cover comprising a pair of facing front and rear sheets sized and shaped to cover the opposite faces of a tennis racket, means including a first zipper securing together the peripheries of said sheets along a major portion of their length from one point to a second point with the space between the points providing an opening for a tennis racket handle, said zipper adapted to be unzipped to open said cover along a length of said major portion from said one point for insertion and removal of a tennis racket, a third sheet facing and coextensive with the half of said second sheet adjacent said points said third sheet having a periphery secured to said second sheet including a transverse edge extending across the second sheet substantially at its center, said second and third sheets forming a thin pocket, an elongated slot in said third sheet providing an opening for said pocket, and second zipper means secured in said.

2. A tennis racket cover as set forth in claim 1 wherein said slot extends parallel to said transverse edge, and said means including a first zipper also including a gusset continuous with said first zipper and securing said first and second sheets together along a length of their peripheries.

3. A tennis racket cover as set forth in claim 2 wherein said sheets are formed of thermoplastic material and said transverse edge is heat sealed to said second sheet.

4. A tennis racket cover as set forth in claim 3 wherein said second zipper includes heat sealable margins with said margins between said second and third sheets and heat sealed to said third sheet about the edges of said slot.

* * * * *